US011504726B2

(12) United States Patent
Xiao

(10) Patent No.: US 11,504,726 B2
(45) Date of Patent: Nov. 22, 2022

(54) WATER DROPLET GENERATING APPARATUS

(71) Applicants: LESHOW ELECTRONIC TECHNOLOGY CO. LTD., Hangzhou (CN); BEIJING XIAOMI MOBILE SOFTWARE CO., LTD., Beijing (CN)

(72) Inventor: Zhaoxian Xiao, Hangzhou (CN)

(73) Assignees: Leshow Electronic Technology Co. Ltd., Hangzhou, Hangzhou (CN); Beijing Xiaomi Mobile Software Co., Ltd., Beijing (CN)

( * ) Notice: Subject to any disclaimer, the term of this patent is extended or adjusted under 35 U.S.C. 154(b) by 71 days.

(21) Appl. No.: 16/613,116

(22) PCT Filed: Apr. 9, 2018

(86) PCT No.: PCT/CN2018/082275
§ 371 (c)(1),
(2) Date: Nov. 12, 2019

(87) PCT Pub. No.: WO2018/219043
PCT Pub. Date: Dec. 6, 2018

(65) Prior Publication Data

US 2021/0078022 A1 Mar. 18, 2021

Related U.S. Application Data

(63) Continuation of application No. PCT/CN2018/082275, filed on Apr. 9, 2018.

(30) Foreign Application Priority Data

May 31, 2017 (CN) ..... 201710426368.8

(51) Int. Cl.
*B05B 5/025* (2006.01)
*B05B 5/053* (2006.01)
*B05B 5/057* (2006.01)

(52) U.S. Cl.
CPC ..... *B05B 5/0255* (2013.01); *B05B 5/057* (2013.01); *B05B 5/0535* (2013.01); *B05B 5/0536* (2013.01)

(58) Field of Classification Search
CPC ... B05B 5/0533; B05B 5/0255; B05B 5/0536; B05B 5/0535; B05B 5/057
See application file for complete search history.

(56) References Cited

U.S. PATENT DOCUMENTS 6,311,903 B1 * 11/2001 Gaw ..... A45D 34/00 239/708
7,494,532 B2 * 2/2009 Azukizawa ..... F24F 6/18 95/71

(Continued)

FOREIGN PATENT DOCUMENTS

CN 1802219 A 7/2006
CN 1809363 A 7/2006

(Continued)

OTHER PUBLICATIONS

Notice of Allowance issued to Japanese Application No. 2019-528696, dated Jul. 2, 2020 with English translation, (5p).

(Continued)

*Primary Examiner* — Joseph A Greenlund
(74) *Attorney, Agent, or Firm* — Arch & Lake LLP

(57) ABSTRACT

An apparatus is provided for generating water droplets. The apparatus includes: a condensation rod for condensing water vapor in air surrounding the condensation rod on the condensation rod; a cooling device being in contact with the condensation rod for cooling the condensation rod; a discharge electrode group including a first electrode and a (Continued)

second electrode cooperating with each other, the first electrode and the second electrode being disposed laterally, and the first electrode and the second electrode are respectively disposed on both sides of the condensation rod; and a high voltage power supply for applying a high voltage to the discharge electrode group to generate a high voltage corona between the first electrode and the second electrode; where the discharge electrode group applies the high voltage corona to the condensation rod, so that condensed water on the condensation rod is excited by the high voltage corona to form atomized water droplets.

19 Claims, 6 Drawing Sheets

(56) References Cited

U.S. PATENT DOCUMENTS 7,644,511 B2 * 1/2010 Ishikawa ..... A45D 20/12 34/96
7,854,403 B2 * 12/2010 Yano ..... B05B 5/0255 239/700
8,191,805 B2 6/2012 Nakada
8,292,202 B2 * 10/2012 Hirai ..... B05B 5/057 239/690
8,398,005 B2 * 3/2013 Nakada ..... B05B 5/057 239/708
D682,226 S * 5/2013 Omori ..... D13/182
8,505,839 B2 * 8/2013 Yano ..... B05B 5/001 239/706
9,101,947 B2 * 8/2015 Kobayashi ..... B05B 5/053
11,026,491 B2 * 6/2021 Xiao ..... A45D 20/12
2002/0074491 A1 6/2002 Fukuda
2003/0205629 A1 * 11/2003 Kelly ..... F23D 11/38 239/690
2005/0097770 A1 * 5/2005 Sabbatini ..... A45D 20/12 34/96
2006/0064892 A1 * 3/2006 Matsui ..... B05B 5/1691 34/96
2006/0131449 A1 * 6/2006 Azukizawa ..... B05B 5/057 239/690
2006/0144971 A1 * 7/2006 Nakada ..... A61L 9/145 239/690
2007/0166208 A1 * 7/2007 Tanaka ..... A45D 20/12 422/186.04
2009/0001200 A1 * 1/2009 Imahori ..... B05B 5/0533 239/690
2009/0121050 A1 * 5/2009 Nakano ..... B05B 5/057 239/690
2009/0134248 A1 * 5/2009 Yamaguchi ..... B05B 5/057 239/132.3
2009/0179092 A1 * 7/2009 Akisada ..... B05B 5/0255 239/602
2009/0206185 A1 * 8/2009 Akisada ..... B05B 5/057 239/690
2010/0044475 A1 2/2010 Nakada et al.
2010/0327089 A1 * 12/2010 Nakada ..... A61L 9/14 239/690
2011/0031335 A1 * 2/2011 Hirai ..... B05B 5/057 239/690
2012/0067986 A1 * 3/2012 Kobayashi ..... H01L 35/34 239/690
2012/0175440 A1 * 7/2012 Uegaki ..... H05K 9/0049 239/690
2013/0020497 A1 * 1/2013 Suda ..... A61L 2/14 250/423 R
2013/0146683 A1 * 6/2013 Imai ..... B05B 5/057 239/690
2013/0153690 A1 * 6/2013 Omori ..... B05B 5/00 239/690
2013/0320117 A1 * 12/2013 Kobayashi ..... B05B 5/057 239/690
2014/0203117 A1 * 7/2014 Yano ..... B05B 7/0075 239/690
2014/0209710 A1 * 7/2014 Komura ..... B05B 5/053 239/690
2016/0096185 A1 4/2016 Nobuo et al.
2016/0116193 A1 * 4/2016 Uratani ..... B05B 5/0255 239/690
2018/0034248 A1 * 2/2018 Ishigami ..... B05B 5/057
2019/0115144 A1 * 4/2019 Park ..... H01F 27/2876
2019/0269219 A1 * 9/2019 Xiao ..... A45D 20/20
2020/0070188 A1 * 3/2020 Xiao ..... B05B 5/0536
2021/0078022 A1 * 3/2021 Xiao ..... B05B 5/0535

FOREIGN PATENT DOCUMENTS

CN 101444359 A 6/2009
CN 101563165 A 10/2009
CN 102006942 A 4/2011
CN 101563165 B 5/2012
CN 103119384 A 5/2013
CN 105665170 A 6/2016
JP 2004358362 A 12/2004
JP 2005177685 A 7/2005
JP 2006205013 A 8/2006
JP 2008155121 A 7/2008
JP 2009131407 A * 6/2009 ..... B05B 5/057
JP 2009131407 A 6/2009
JP 2009255003 A 11/2009
JP 4415490 B2 2/2010
JP 2010089088 A 4/2010
JP 2011067769 A 4/2011
JP 2013220365 A 10/2013
JP 2014050804 A 3/2014
JP 2014147635 A 8/2014
JP 5612322 B2 10/2014
KR 100716638 B1 5/2007
WO 2009136470 A1 11/2009

OTHER PUBLICATIONS

First Office Action issued to Chinese Application No. 201710426368.8, dated Jul. 9, 2020 with English translation, (11p).
First Office Action issued to Korean Application No. 10-2019-7009657, dated Jun. 30, 2020 with English translation, (12p).
Extended European Search Report issued to European Application No. 18810327.9, dated May 15, 2020, (7p).
International Search Report (including English translation) and Written Opinion issued in PCT/CN2018/082275, dated Jul. 12, 2018, 9 pages.
Notice of Grant issued to Korean Application No. 10-2019-7009657 dated Jan. 22, 2021with English translation, (6p).

* cited by examiner

WATER DROPLET GENERATING APPARATUS

CROSS-REFERENCE TO RELATED APPLICATIONS

This application is a national phase application under 35 U.S.C. § 371 of International Patent Application No. PCT/CN2018/082275, filed on Apr. 9, 2018, which is based upon and claims priority to Chinese Patent Application No. 201710426368.8, filed on May 31, 2017, the entire contents of which are incorporated herein by reference for all purposes.

TECHNICAL FIELD

The present disclosure relates to the atomizing apparatuses and, more particularly, to an apparatus for generating water droplets.

BACKGROUND

In the apparatus for generating high-voltage corona atomizing water particles existing in the industry, the cooling apparatus cools an emitter electrode and condenses water vapor in surrounding air on the emitter electrode. When a high voltage power supply applies a high voltage to the emitter electrode, water condensed on the emitter electrode is atomized by a high voltage corona. The emitter electrode has two functions of discharge and condensation, and the emitter electrode discharges while gathering the condensed water, thus resulting in a high requirement for modeling of the emitter electrode, and a high defective rate and processing cost of the molding. At the same time, a counter pole opposite to the emitter electrode is disposed at a top of the emitter electrode, which has a disadvantage of blocking a movement of the atomized water particles.

SUMMARY

The present disclosure provides an apparatus for generating water droplets.

According to a first aspect of the present disclosure, an apparatus for generating water droplets is provided, including: a condensation rod for condensing water vapor in air surrounding the condensation rod on the condensation rod; a cooling device being in contact with the condensation rod for cooling the condensation rod; a discharge electrode group, including a first electrode and a second electrode cooperating with each other, where the first electrode and the second electrode are disposed laterally, and the first electrode and the second electrode are respectively disposed on both sides of the condensation rod; and a high voltage power supply for applying a high voltage to the discharge electrode group, so as to generate a high voltage corona between the first electrode and the second electrode; where the discharge electrode group applies the high voltage corona to the condensation rod, so that condensed water on the condensation rod is excited by the high voltage corona to form atomized water droplets.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure.

DETAILED DESCRIPTION

Figure 1:
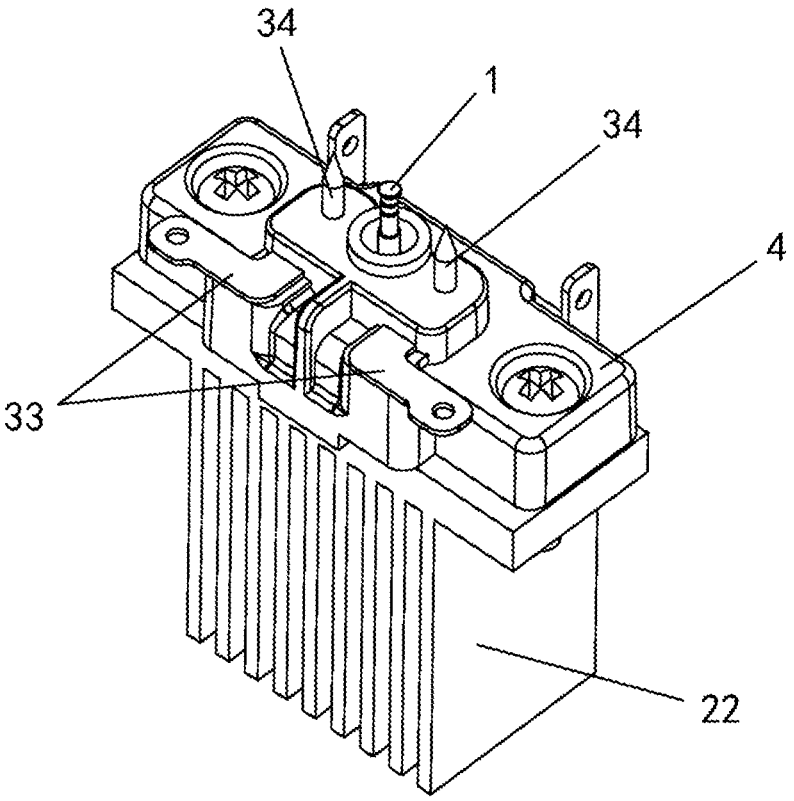
FIG. 1 is a schematic diagram illustrating an apparatus for generating water droplets, according to an example of the present disclosure.
Figure 2:
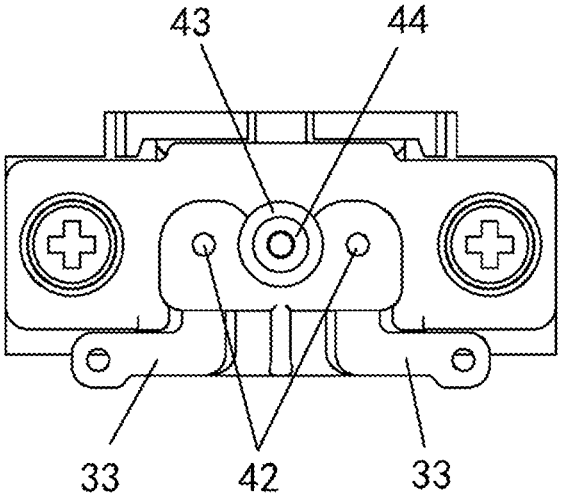
FIG. 2 is a top view illustrating the apparatus for generating water droplets, according to an example of the present disclosure.
Figure 3:
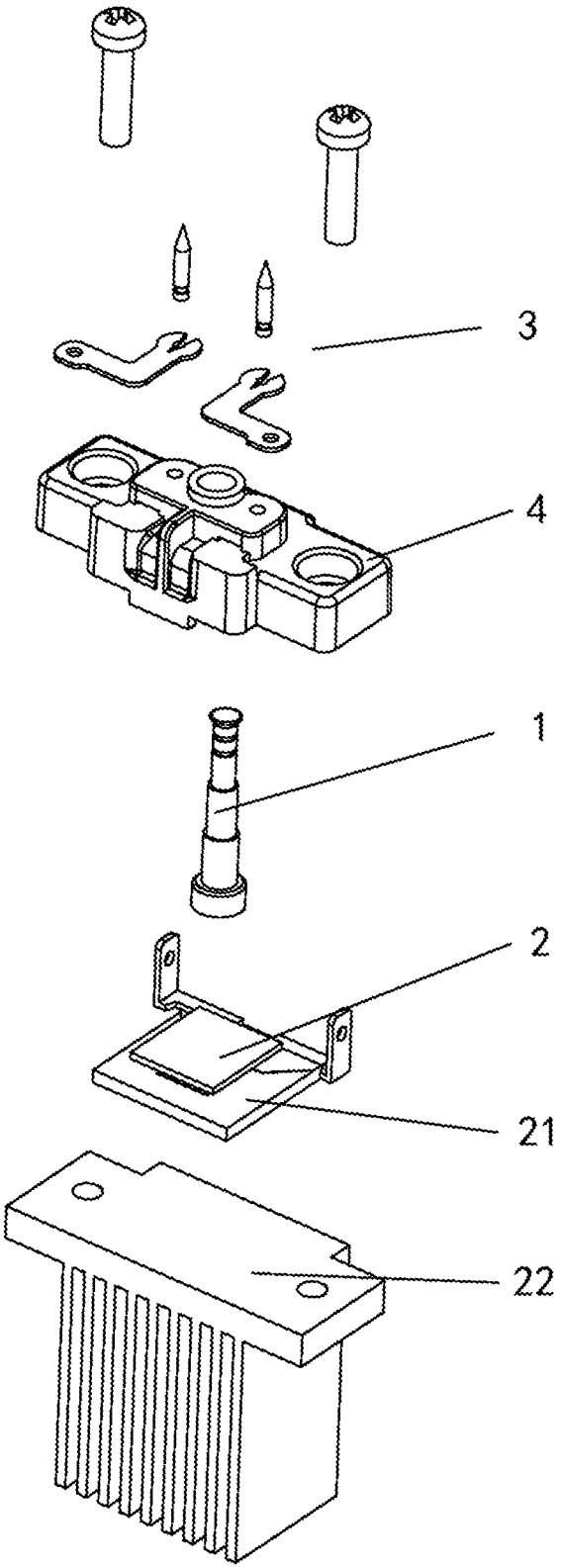
FIG. 3 is an explosive view illustrating the apparatus for generating water droplets, according to an example of the present disclosure.
Figure 4:
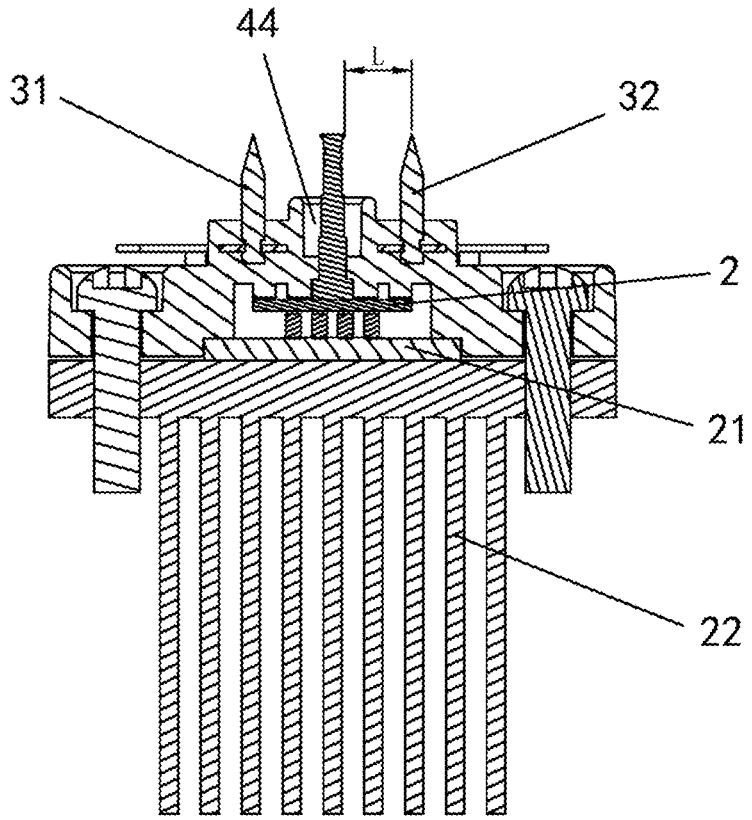
FIG. 4 is a sectional view illustrating the apparatus for generating water droplets, according to an example of the present disclosure.
Figure 5:
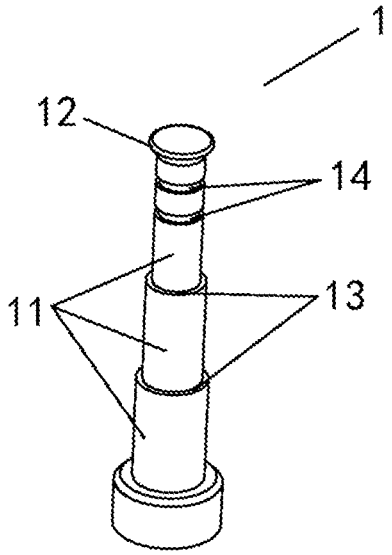
FIG. 5 is a schematic diagram illustrating a condensation rod, according to an example of the present disclosure.
Figure 6:
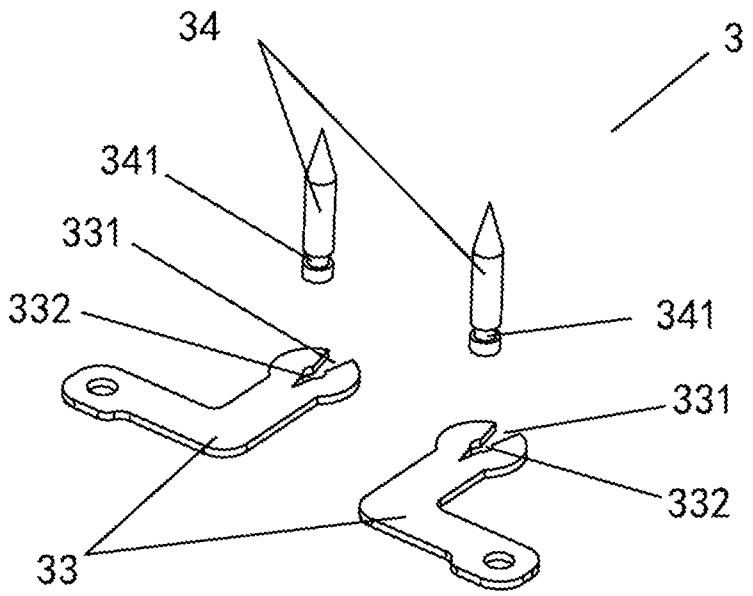
FIG. 6 is an explosive view illustrating a discharge electrode group, according to an example of the present disclosure.
Figure 7:
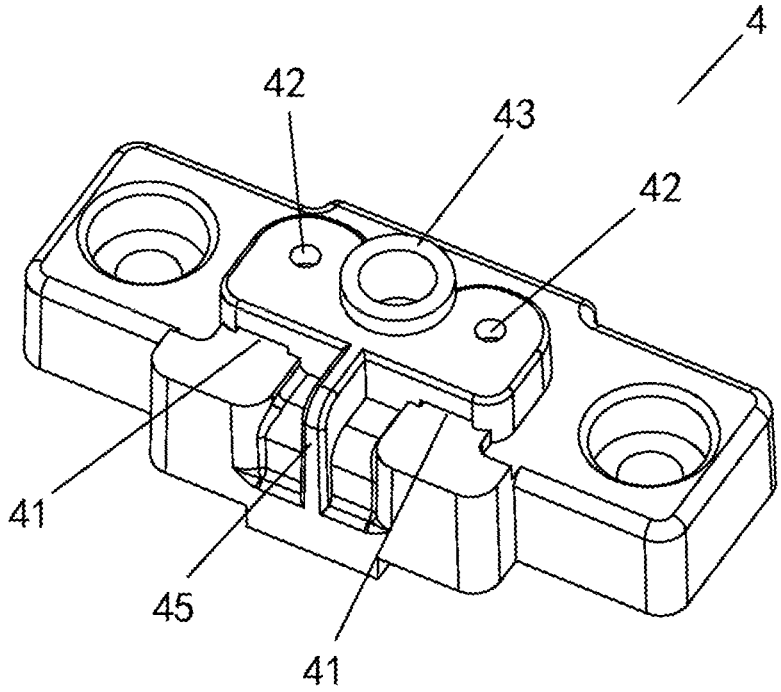
FIG. 7 is a schematic diagram illustrating an insulating bracket, according to an example of the present disclosure.

The present disclosure will be further described below with reference to the accompanying drawings. The following description refers to the accompanying drawings in which the same numbers in different drawings represent the same or similar elements unless otherwise represented. The implementations set forth in the following description of exemplary aspects do not represent all implementations consistent with the present disclosure. Instead, they are merely examples of apparatuses consistent with aspects related to the present disclosure.

The terminology used in the present disclosure is for the purpose of describing particular examples only and is not intended to limit the present disclosure. As used in this disclosure and the appended claims, the singular forms "a", "an", and "the" are intended to include the plural forms as well, unless the context clearly indicates otherwise.

It should be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. The terms "water droplets" and "water particles" may be used interchangeably in the present disclosure.

The example provides an apparatus for generating water particles, as shown in FIG. 1 to FIG. 7, including: a condensation rod 1 for condensing water in air surrounding the condensation rod 1 on the condensation rod 1; a cooler or cooling device 2 being in contact with the condensation rod 1 for cooling the condensation rod 1; a discharge electrode group 3, including a first electrode 31 and second electrode 32 cooperating with each other, where the first electrode 31 and the second electrode 32 are disposed laterally, and the first electrode 31 and the second electrode 32 are respectively disposed on both sides of the condensation rod 1; and a high voltage power supply for applying a high voltage to the discharge electrode group 3 to generate a high voltage corona between the first electrode 31 and the second electrode 32; where the discharge electrode group 3 applies the high voltage corona to the condensation rod 1, so that condensed water on the condensation rod 1 is excited by the high voltage corona to form atomized water particles. In the example of the present disclosure, the discharge electrode group 3 includes the first electrode 31 and the second electrode 32 cooperating with each other, and the first electrode 31 and the second electrode 32 are disposed laterally, so that the discharge direction is transverse, and the condensed water is not easy to splash. And the first electrode 31 and the second electrode 32 are respectively disposed on both sides of the condensation rod, thus the condensation rod 1 is ensured to be within the high voltage corona generated by the discharge electrode group 3 under the high voltage, and the high voltage corona is not easily mismatched with a position of the condensation rod 1.

The first electrode 31 and the second electrode 32 each includes a connection locking piece 33 and a discharge tip 34, and the connection locking pieces 33 and the discharge tip 34*s* are completely isolated from the cooling device by an insulating bracket 4. In the example, the first electrode 31 and the second electrode 32 are insulated from the cooling device by the insulating bracket 4, thereby preventing the cooling device 2 from being broken down or being failed in a high voltage magnetic field due to the high voltage that the first electrode 31 and the second electrode 32 are subjected to.

In the example, the discharge tip 34 is a discharge needle having a tapered tip, the insulating bracket 4 is provided with a slot 41 for inserting a connection locking piece 33, the slot 41 is insulated from the cooling device 2, one end of the discharge needle extends into the slot 41 to be electrically connected to the connection locking piece 33, and the other end of the discharge needle extends beyond a surface of the insulating bracket 4 to allow the tapered tip of the discharge needle to have an effect on the condensation rod 1. In the example, a built-in connection locking piece 33 is designed, and one end of the discharge needle is pre-buried in the insulating bracket 4, which not only makes an installation of the connection locking piece 33 and the discharge needle more stable, but also makes an electrical connection of the discharge needle and the connection locking piece 33 more reliable. In addition, the pre-buried design also ensures that a relative discharge position of the discharge needle and the condensation rod 1 is stable. In the example of the present disclosure, the insulating bracket 4 is further provided with an insulating partition 45 for isolating the two connection locking pieces 33. The insulating partition 45 effectively isolates the first electrode 31 and the second electrode 32 to ensure insulation safety between the two electrodes.

The end of the discharge needle extending into the slot 41 is provided with a groove 341, and the end of the connection locking piece 33 is provided with a notch 331 cooperating with the groove 341 of the discharge needle. The notch 331 is in a triangular shape, and a part of the notch at the end of the connection locking piece 33 is the largest. In the example of the present disclosure, the cooperation between the connection locking piece 33 and the discharge needle adopt a clamping manner, so that the installation is convenient, and the notch 331 designed at the end of the connection locking piece 33 makes the installation elastic deformation large and does not easily damage the discharge needle. The notch 331 of the connection locking piece 33 is provided with a limiting port 332 cooperating with the groove 341 of the discharge needle for clamping. The limiting port 332 is disposed in the middle of the triangular notch. In an example, the end of the connection locking piece 33 is circular, and the limiting port 332 is disposed at a center of the circular connection locking piece 33. The limiting port 332 is disposed in the notch 331, so that the groove 341 of the discharge needle is uniquely positioned at the limiting port 332 after being inserted into the notch 331, thereby ensuring the stability of the connection therebetween.

The condensation rod 1 has a condensing surface 11 for aggregating condensed water, and the condensing surface 11 has a horizontal discharge gap L with both the first electrode 31 and the second electrode 32, and the discharge gap L is 0.3 to 5 mm. That is, the condensing surface 11 has a horizontal discharge gap L with the first electrode 31, and has a horizontal discharge gap L with the second electrode 32 as well. In the example, the discharge gap L is preferably 2 mm. In the example of the present disclosure, the discharge gap L may better excite the condensed water to form atomized water particles, and enhance the atomization effect of the condensed water. The condensation rod 1 in the example of the present disclosure is a cylinder that is rotationally symmetric about a central axis, and a circumferential surface of the cylinder is a condensing surface 11 for aggregating the condensed water, allowing the condensed water to condense to the condensing surface of the cylinder of the condensation rod, so that a condensed area available for the condensed water is large. Since the condensation rod 1 is in a shape of a cylinder, and the circumferential surface thereof has no inclined tapered slope, the water vapor in the air may be uniformly disposed on the condensing surface of the cylinder. When the condensed water aggregates to a certain volume, it may slide down smoothly to avoid an excessive amount of water wrapped around the condenser rod 1 and weakening atomization effect. In the example, the top of the condensation rod 1 has a water collecting end 12 that expands outward from the condensing surface 11, and a diameter of an outer edge of the water collecting end 12 is larger than a circumferential diameter of the condensing surface. In the example, the top of the condensation rod 1 has the water collecting end 12, and the diameter of the outer edge of the water collecting end 12 is larger than the circumferential diameter of the condensing surface. When the condensed water is generated on the condensing surface, due to occlusion of the water collecting end 12, the condensed water may be effectively prevented from coming off the condensing surface under driving of air flow. A top surface of the water collecting end 12 is flat. In order to avoid discharge of the condensation rod 1 on its top, a flat water collecting end 12 is provided to avoid movement of charged ions attached on the condensation rod 1 towards the top of the condensation rod. The above discharge gap L is a gap between the outer circumference of the water collecting end 12 and the tapered tip of the discharge needle.

The apparatus for generating water particles is further provided with the insulating bracket 4, the discharge electrode group 3 and the cooling device 2 are installed on upper and lower sides of the insulating bracket 4, respectively, the insulating bracket 4 is provided with a fitting bore 42 for the condensation rod, and the condensation rod 1 is extended from a side of the insulating bracket 4 on which the cooling device 2 is installed to a side of the insulating bracket 4 on which the discharge electrode group 3 is installed. The insulating bracket 4 isolates the electrode group 3 from the cooling device 2, and the condensation rod 1 protrudes from the side of the cooling device 2 to the side of the discharge electrode group 3 through the fitting bore for the condensation rod, so that one end of the condensation rod 1 may directly contact the cooling device 2, the other end thereof is disposed in the high voltage corona of the discharge electrode group 3, and the discharge electrode group 3 is insulated from the cooling device 2 to avoid damage to the cooling device 2. The cooling device 2 is further provided with a heat dissipation module 21. The heat dissipation module 21 is integrally formed with the cooling device 2, and the heat dissipation module 21 deviates from the condensation rod 1. In order to enhance cooling effect of the cooling device 2, the side of the cooling device 2 away from the condensation rod 1 is equipped with the heat dissipation module 21. The apparatus for generating water particles is further provided with a heat dissipating fin 22. The heat dissipating fin 22 is in contact with the heat dissipating module 21 and extends in a direction away from the condensation rod 1. The heat dissipating fin 2 accelerates cooling of the cooling device 2 to the side away from the condensation rod 1, and ensures the cooling effect on the side on which the condensation rod 1 is attached.

The insulating bracket 4 is provided with a water collecting boss or projection 43 surrounding the condensation rod 1, the water collecting projection 43 forms a sump or recess 44 surrounding a bottom of the condensation rod 1, and the water collecting projection 43 is disposed between the condensation rod 1 and the discharge electrode group 3. In the example of the present disclosure, the insulating bracket 4 is provided with the water collecting projection 43, and when the water condensed on the condensation rod 1 is continuously increased and slides down along the condensation rod 1, the sump 44 formed by the water collecting projection 43 surrounding the bottom of the condensation rod 1 may receive the condensed water, thereby avoiding the condensed water overflowing to the discharge electrode group 3 to cause the condensation rod 1 to be electriferous or the two electrodes of the discharge electrode group 3 to be conducted, and avoiding safety hazards such as fire and short circuit. At the same time, the sump 44 can ensure a stable amount of the condensed water wrapping around the condensation rod 1, avoid an air discharge to the dry condensation rod 1 to affect the service life of the condensation rod 1. In order to further ensure the stable amount of water wrapping around the condensation rod 1, in the example of the present disclosure, the condensing surface 11 of the condensation rod is further provided with a flow slowing step 13 or flow hindering stair 13 with a gradually increasing outer circumference from top to bottom. In order to ensure the effect of uniform condensation, a cylindrical condensation rod is designed in the example, and at the same time, it can facilitate the condensed water, when aggregating to a certain volume, to smoothly slide down. When the condensed water slides down, the condensed water on the condensation rod 1 is suddenly reduced. In order to ensure that a certain amount of atomizing medium (i.e., water) is attached on the condensation rod 1, in the example of the present disclosure, the flow hindering stair 13 with a gradually increasing outer circumference is designed to keep water on the flow hindering stair 13 at all times for discharge atomization, and to ensure material safety and service life of the condensation rod 1. In the example, the condensing surface 11 is further provided with a water collecting groove 14, and the water collecting groove is an annular water collecting groove that is recessed around the condensing surface. In order to ensure attachment of the atomizing medium on the condensation rod, the water collecting groove 14 is provided, and the annular water collecting groove which is recessed around the condensing surface can ensure uniform condensed water volume in the water collecting groove 14 and good discharge atomization effect.

In the discharge electrode group 3 of the apparatus for generating water particles in the example of the present disclosure, the condensed water is not easy to splash, the atomization effect is excellent, the discharge component is installed stably, the electrical connection is reliable, and the insulating bracket 4 isolates the discharge electrode group 3 from the cooling device 2. The water collecting projection 43 surrounds the condensation rod 1 and is disposed between the condensation rod 1 and the discharge electrode group 3. The parts are insulated from each other and are safe, and the atomization effect is reliable.

Figure 8:
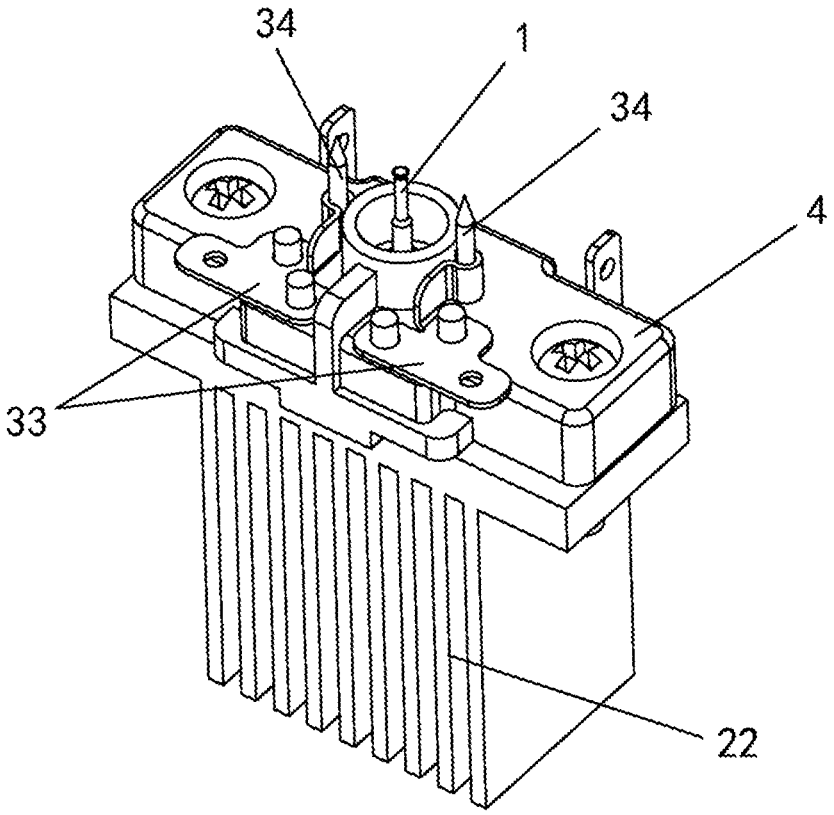
FIG. 8 is a schematic diagram illustrating an apparatus for generating water droplets, according to an example of the present disclosure.
Figure 9:
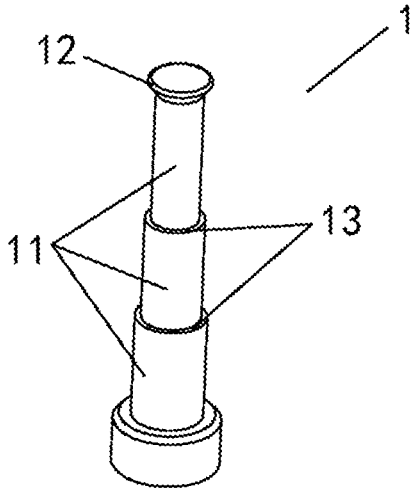
FIG. 9 is a schematic diagram illustrating a condensation rod, according to an example of the present disclosure.

The difference between the example and the first example is that, as shown in FIG. 8 and FIG. 9, a discharge tip 34 is a discharge needle having a tapered tip, the connection locking piece 33 is installed on one side of the insulating bracket away from the cooling device 2, and the end of the connection locking piece 33 wraps the discharge needle and allows the tapered tip of the discharge needle to have an effect on the condensation rod 1. In the example of the present disclosure, the connection locking piece 33 wraps the discharge needle, so that the contact area between the connection locking piece 33 and the discharge needle is maximized, the electrical connection effect is ensured, and the spark is avoided at a joint between the connection locking piece 33 and the discharge needle.

In the example, it is unnecessary to provide a water collecting recess on the condensing surface 11, and the condensing surface 11 of the condensation rod is provided with the flow hindering stair 13 with a gradually increasing outer circumference from top to bottom, thereby ensuring the stable amount of condensed water wrapping around the condensation rod 1.

Figure 10:
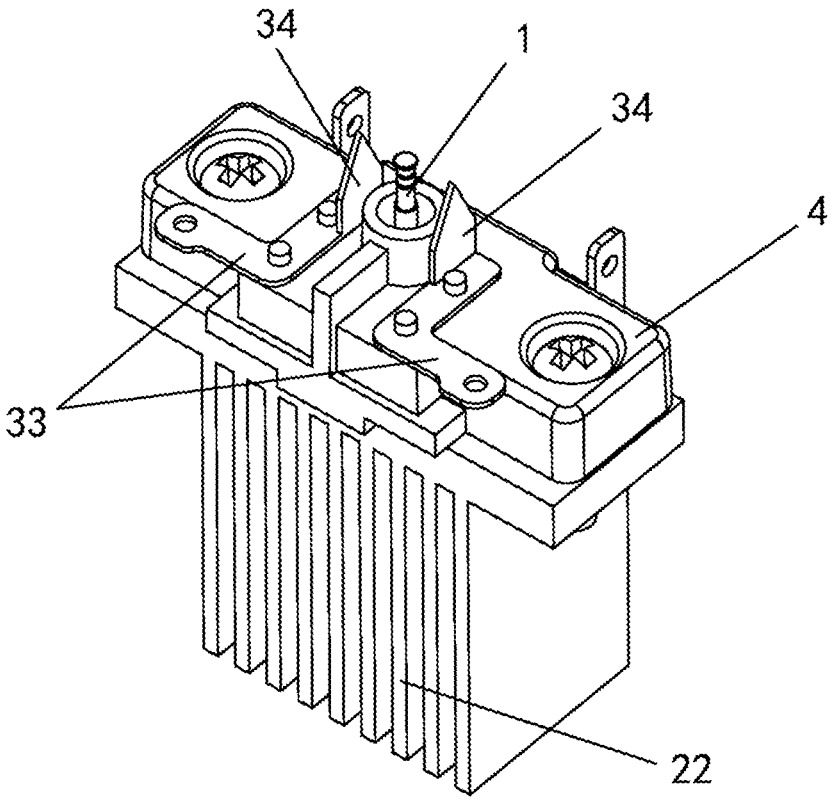
FIG. 10 is a schematic diagram illustrating an apparatus for generating water droplets, according to an example of the present disclosure.

The difference between the example and the first example is that, in the apparatus for generating water particles shown in FIG. 10, the discharge tip 34 is a discharge piece or a discharge strip having a tapered end (or pointed end), the discharge piece is integrally formed with the connection locking piece 33 and the tapered end of the discharge piece acts on the condensation rod 1 when a high voltage corona is generated. The discharge tip 34 is designed in a sheet shape and is integrally formed with the connection locking piece 33, which reduces the forming difficulty of the discharge electrode group, and the relative area between the two discharge tips is large, ensuring that the condensation rod 1 is in a high voltage corona generated by the discharge electrode group under a high voltage, the high voltage corona is not easily mismatched with the position of the condensed water, and atomization effect of the condensed water condensed on the condensation rod 1 is excellent. In the example, the discharge gap L between the discharge piece and the condensing surface 11 may be selected to be 5 mm.

Figure 11:
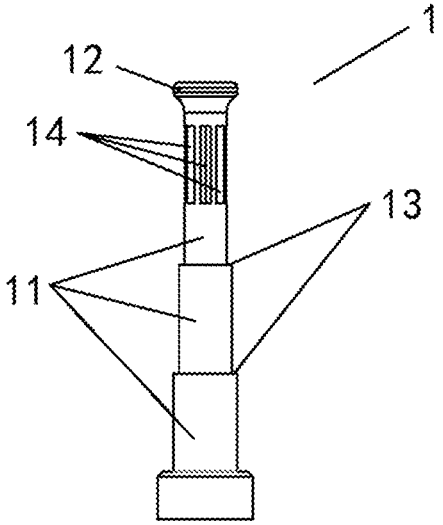
FIG. 11 is a schematic diagram illustrating a condensation rod, according to an example of the present disclosure.

The difference between the example and the first example is that, in the condensation rod shown in FIG. 11, a water collecting end 12 is transitionally connected to a condensing surface 11 via a concave arc. In order to prevent the charged ions attached on the condensation rod 1 from moving toward a sharp corner joint to cause a discharge phenomenon, the water collecting end 12 and the condensing surface 11 adopt a smooth transition to avoid a connection sharp angle. When the apparatus is in airflow, the condensed water may move from the condensing surface 11 to the water collecting end 12. In order to prevent the condensed water from flowing to the top of the water collecting end 12, the water collecting end 12 and the condensing surface 11 are designed to have a concave arc transition. The concave arc transition makes the movement direction of condensed water change from the longitudinal diversion to the transverse direction, so that the condensed water is discharged around the water collecting end 12.

In the example, the condensing surface 11 is provided with a water collecting groove 14, the water collecting groove 14 is a longitudinal water collecting groove disposed along the axial direction of the condensation rod 1, and the longitudinal water collecting groove is disposed along the circumference of the condensing surface. Multiple longitudinal water collecting grooves may be provided in parallel on the condensing surface. The longitudinal water collecting grooves 14 circumferentially disposed are suitable for more environments, and the water collecting grooves do not interfere with each other, thereby ensuring the minimum amount of condensation.

In the examples of the present disclosure, the discharge electrode group includes a first electrode and a second electrode cooperating with each other, the first electrode and the second electrode are disposed on both sides of the condensation rod, respectively, and the first electrode and the second electrode of the discharge electrode group surround the condensation rod, and in this way, the condensation rod is in the high voltage corona generated by the discharge electrode group under the high voltage, and the high voltage corona is matched with the position of the condensation rod and displacement is not easily occurred. And the first electrode and the second electrode are disposed laterally, so that the discharge direction is transverse, the condensed water is not easy to splash, and atomization effect of the condensed water condensed on the condensation rod is excellent.

The first electrode and the second electrode each includes a connection locking piece and a discharge tip, and the connection locking pieces and the discharge tips are completely isolated from the cooling device by an insulating bracket. In the examples of the present disclosure, the first electrode and the second electrode are insulated from the cooling device by the insulating bracket, thereby preventing the cooling device from being broken down or being failed in a high voltage magnetic field due to the high voltage that the first electrode and the second electrode are subjected to.

The discharge tip is a discharge needle having a tapered tip, the insulating bracket is provided with a slot for inserting a connection locking piece, the slot is insulated from the cooling device, one end of the discharge needle extends into the slot to be electrically connected to the connection locking piece, and the other end of the discharge needle extends beyond a surface of the insulating bracket to allow the tapered tip of the discharge needle to act on the condensation rod. In the examples of the present disclosure, a built-in connection locking piece is designed, and one end of the discharge needle is pre-buried in the insulating bracket, which not only makes an installation of the connection locking piece and the discharge needle more stable, but also makes an electrical connection between the discharge needle and the connection locking piece more reliable. In addition, the pre-buried design also ensures that a relative discharge position of the discharge needle and the condensation rod is stable.

The end of the discharge needle extending into the slot is provided with a groove, an end of the connection locking piece is provided with a notch cooperating with the groove of the discharge needle, the notch is in a triangular shape, and a part of the notch at the end of the connection locking piece is the largest. In the example of the present disclosure, the cooperation between the connection locking piece and the discharge needle adopts a clamping manner, so that the installation is convenient, and the notch design at the end of the connection locking piece makes the installation elastic deformation large and does not easily damage the discharge needle.

The notch of the connection locking piece is provided with a limiting port cooperating with the groove of the discharge needle for clamping. The limiting port is disposed in the notch, so that the groove of the discharge needle is uniquely positioned at the limiting port after being inserted into the notch, thereby ensuring the stability of the connection therebetween.

The discharge tip is a discharge needle having a tapered tip, the connection locking piece is installed on one side of the insulating bracket away from the cooling device, and an end of the connection locking piece wraps the discharge needle and allows the tapered tip of the discharge needle to act on the condensation rod. In the example of the present disclosure, the connection locking piece wraps the discharge needle, so that a contact area between the connection locking piece and the discharge needle is maximized, an electrical connection effect is ensured, and a spark is avoided to be occurred at a joint between the connection locking piece and the discharge needle.

The discharge tip is a discharge piece having a tapered end, and the discharge piece is integrally formed with the connection locking piece to make the sharp corner of the discharge piece act on the condensation rod. The discharge tip is designed to be a sheet shape and is integrally formed with the connection locking piece, which reduces forming difficulty of the discharge electrode group, and a relative area between the two discharge tips is large, ensuring that the condensation rod is in the high voltage corona generated by the discharge electrode group under the high voltage, the high voltage corona is cooperated with the position of the condensed water and displacement is not easily occurred, and atomization effect of the condensed water condensed on the condensation rod is excellent.

The condensation rod has a condensing surface for aggregating condensed water, the condensing surface has a horizontal discharge gap with both the first electrode and the second electrode, and the discharge gap is 0.3 to 5 mm. In the example of the present disclosure, the discharge gap may better excite the condensed water to form atomized water particles, and enhance the atomization effect of the condensed water.

The apparatus for generating water particles is further provided with an insulating bracket, the discharge electrode group and the cooling device are installed on upper and lower sides of the insulating bracket, respectively, the insulating bracket is provided with a fitting bore for the condensation rod, and the condensation rod extends from a side of the insulating bracket on which the cooling device is installed to a side of the insulating bracket on which the discharge electrode group is installed. The insulating bracket isolates the discharge electrode group from the cooling device, and the condensation rod protrudes from the side of the cooling device to the side of the discharge electrode group through the fitting bore for the condensation rod, so that one end of the condensation rod can directly contact the cooling device, the other end thereof is disposed in the high voltage corona of the discharge electrode group, and the discharge electrode group is insulated from the cooling device to avoid damage to the cooling device.

The insulating bracket is provided with a water collecting projection surrounding the condensation rod, the water collecting projection forms a sump surrounding a bottom of the condensation rod, and the water collecting projection is between the condensation rod and the discharge electrode group. In the example of the present disclosure, the insulating bracket is provided with the water collecting projection, and when the water condensed on the condensation rod is continuously increased and slides down along the condensation rod, the sump formed by the water collecting projection surrounding the bottom of the condensation rod may receive the condensed water, thereby avoiding the condensed water overflowing to the discharge electrode group to cause the condensation rod to be electriferous or the two electrodes of the discharge electrode group to be conducted, and avoiding safety hazards such as fire and short circuit. At the same time, the sump can ensure a stable amount of the condensed water wrapping around the condensation rod, and avoid an air discharge to a dry condensation rod to affect the service life of the condensation rod.

With the discharge electrode group of the apparatus for generating water particles according to the examples of the present disclosure, the condensed water is not easy to splash, the atomization effect is excellent, the discharge component is installed stably, the electrical connection is reliable, and the insulating bracket isolates the discharge electrode group from the cooling device. The water collecting projection surrounds the condensation rod and is disposed between the condensation rod and the discharge electrode group. The parts are insulated from each other and are safe, and the atomization effect is reliable.

The above implementation manners are only examples of the present disclosure, rather than all examples of the present disclosure. According to the principles of the present disclosure, the person skilled in the art could make various modifications. Such modifications without departing from the spirit of the present disclosure should belong to the scope of the present disclosure.

What is claimed is:

1. An apparatus for generating water droplets, comprising:

a condensation rod for condensing water vapor in air surrounding the condensation rod on the condensation rod;

an insulating bracket;

a discharge electrode group comprising a first electrode and a second electrode cooperating with each other, wherein the first electrode and the second electrode are disposed laterally, and the first electrode and the second electrode are respectively disposed on both sides of the condensation rod; and a power supply for applying a voltage to the discharge electrode group, so as to generate a corona between the first electrode and the second electrode;

wherein the discharge electrode group applies the corona to the condensation rod, so that condensed water on the condensation rod is excited by the corona to form atomized water droplets, wherein the first electrode and the second electrode each comprise a discharge tip, and the discharge tip of the first electrode and the discharge tip of the second electrode are disposed on both sides of the condensation rod, and wherein the first electrode and the second electrode each comprises a connection locking piece, the discharge tip is a discharge needle having a tapered tip, the insulating bracket is provided with a slot for inserting the connection locking piece, and one end of the discharge needle extending into the slot is provided with a groove, an end of the connection locking piece is provided with a notch cooperating with the groove of the discharge needle, the notch is in a triangular shape, and a part of the notch at the end of the connection locking piece is the largest.

2. The apparatus according to claim 1, wherein the apparatus further includes a cooler being in contact with the condensation rod, and the connection locking pieces and the discharge tips are completely isolated from the cooler by the insulating bracket.

3. The apparatus according to claim 2, wherein the slot is insulated from the cooler, the end of the discharge needle extends into the slot to be electrically connected to the connection locking piece, and the other end of the discharge needle extends beyond a surface of the insulating bracket and the tapered tip of the discharge needle applies the corona to the condensation rod.

4. The apparatus according to claim 3, wherein the discharge electrode group and the cooler are installed on upper and lower sides of the insulating bracket, respectively, the insulating bracket is provided with a fitting bore of the condensation rod, and the condensation rod is extended from a side of the insulating bracket on which the cooler is installed to a side of the insulating bracket on which the discharge electrode group is installed.

5. The apparatus according to claim 4, wherein the insulating bracket is provided with a water collecting projection surrounding the condensation rod, the water collecting projection forms a recess surrounding a bottom of the condensation rod, and the water collecting projection is between the condensation rod and the discharge electrode group.

6. The apparatus according to claim 2, wherein the discharge tip is a discharge needle having a tapered tip, the connection locking piece is installed on one side of the insulating bracket away from the cooler, and an end of the connection locking piece wraps the discharge needle and the tapered tip of the discharge needle applies the corona to the condensation rod.

7. The apparatus according to claim 6, wherein the discharge electrode group and the cooler are installed on upper and lower sides of the insulating bracket, respectively, the insulating bracket is provided with a fitting bore of the condensation rod, and the condensation rod is extended from a side of the insulating bracket on which the cooler is installed to a side of the insulating bracket on which the discharge electrode group is installed.

8. The apparatus according to claim 2, wherein the discharge tip is a discharge strip having a tapered end, and the discharge strip is integrally formed with the connection locking piece, and the tapered tip of the discharge needle applies the corona to the condensation rod.

9. The apparatus according to claim 8, wherein the discharge electrode group and the cooler are installed on upper and lower sides of the insulating bracket, respectively, the insulating bracket is provided with a fitting bore of the condensation rod, and the condensation rod is extended from a side of the insulating bracket on which the cooler is installed to a side of the insulating bracket on which the discharge electrode group is installed.

10. The apparatus according to claim 2, wherein the discharge electrode group and the cooler are respectively installed on upper and lower sides of the insulating bracket, the insulating bracket is provided with a fitting bore for the condensation rod, and the condensation rod is extended from a side of the insulating bracket on which the cooler is installed to a side of the insulating bracket on which the discharge electrode group is installed.

11. The apparatus according to claim 10, wherein the insulating bracket is provided with a water collecting projection surrounding the condensation rod, the water collecting projection forms a recess surrounding a bottom of the condensation rod, and the water collecting projection is between the condensation rod and the discharge electrode group.

12. The apparatus according to claim 2, wherein the discharge electrode group and the cooler are installed on upper and lower sides of the insulating bracket, respectively, the insulating bracket is provided with a fitting bore of the condensation rod, and the condensation rod is extended from a side of the insulating bracket on which the cooler is installed to a side of the insulating bracket on which the discharge electrode group is installed.

13. The apparatus according to claim 1, wherein the notch of the connection locking piece is provided with a limiting port cooperating with the groove of the discharge needle for clamping.

14. The apparatus according to claim 13, wherein the discharge electrode group and the cooler are installed on upper and lower sides of the insulating bracket, respectively, the insulating bracket is provided with a fitting bore of the condensation rod, and the condensation rod is extended from a side of the insulating bracket on which the cooler is installed to a side of the insulating bracket on which the discharge electrode group is installed.

15. The apparatus according to claim 1, wherein the condensation rod has a condensing surface for aggregating condensed water, the condensing surface has a horizontal discharge gap with both the first electrode and the second electrode, and the discharge gap is 0.3 to 5 mm.

16. The apparatus according to claim 1, wherein the apparatus further comprises a cooler, the discharge electrode group and the cooler are respectively installed on upper and lower sides of the insulating bracket, the insulating bracket is provided with a fitting bore for the condensation rod, and the condensation rod is extended from a side of the insulating bracket on which the cooler is installed to a side of the insulating bracket on which the discharge electrode group is installed.

17. The apparatus according to claim 16, wherein the insulating bracket is provided with a water collecting projection surrounding the condensation rod, the water collecting projection forms a recess surrounding a bottom of the condensation rod, and the water collecting projection is between the condensation rod and the discharge electrode group.

18. The apparatus according to claim 1, wherein the discharge electrode group and the cooler are installed on upper and lower sides of the insulating bracket, respectively, the insulating bracket is provided with a fitting bore of the condensation rod, and the condensation rod is extended from a side of the insulating bracket on which the cooler is installed to a side of the insulating bracket on which the discharge electrode group is installed.

19. The apparatus according to claim 18, wherein the insulating bracket is provided with a water collecting projection surrounding the condensation rod, the water collecting projection forms a recess surrounding a bottom of the condensation rod, and the water collecting projection is between the condensation rod and the discharge electrode group.

* * * * *